US006927510B1

(12) United States Patent
Beitelman et al.

(10) Patent No.: US 6,927,510 B1
(45) Date of Patent: Aug. 9, 2005

(54) COOLING ELECTROMAGNETIC STIRRERS

(75) Inventors: Leonid Beitelman, Thornhill (CA); Vladimir Segal, Livingston, NJ (US); Christopher P. Curran, Pontypool (CA)

(73) Assignee: ABB Inc., Whitby (CA)

( * ) Notice: Subject to any disclaimer, the term of this patent is extended or adjusted under 35 U.S.C. 154(b) by 0 days.

(21) Appl. No.: 10/206,182

(22) Filed: Aug. 20, 2002

(51) Int. Cl.[7] ..... H20K 9/200
(52) U.S. Cl. ..... 310/54; 310/52; 310/58; 310/11
(58) Field of Search ..... 310/54, 11, 52, 310/58

(56) References Cited

U.S. PATENT DOCUMENTS 4,506,895 A 3/1985 Raj
4,992,190 A 2/1991 Shtarkman
5,462,685 A 10/1995 Raj et al.
5,863,455 A 1/1999 Segal
5,898,353 A 4/1999 Cader et al.
6,225,705 B1 * 5/2001 Nakamats ..... 290/43
6,316,850 B1 * 11/2001 Nakamura ..... 310/238
6,412,289 B1 * 7/2002 Laskaris ..... 62/50

FOREIGN PATENT DOCUMENTS

JP 1-186140 * 1/1988 ..... H02K/9/00

* cited by examiner

*Primary Examiner*—Dang Le
*Assistant Examiner*—Iran A. Mohandesi
(74) *Attorney, Agent, or Firm*—Sim & McBurney

(57) ABSTRACT

Cooling of the electrical coils of an electromagnetic stirrer is effected using a ferrofluid.

6 Claims, 11 Drawing Sheets

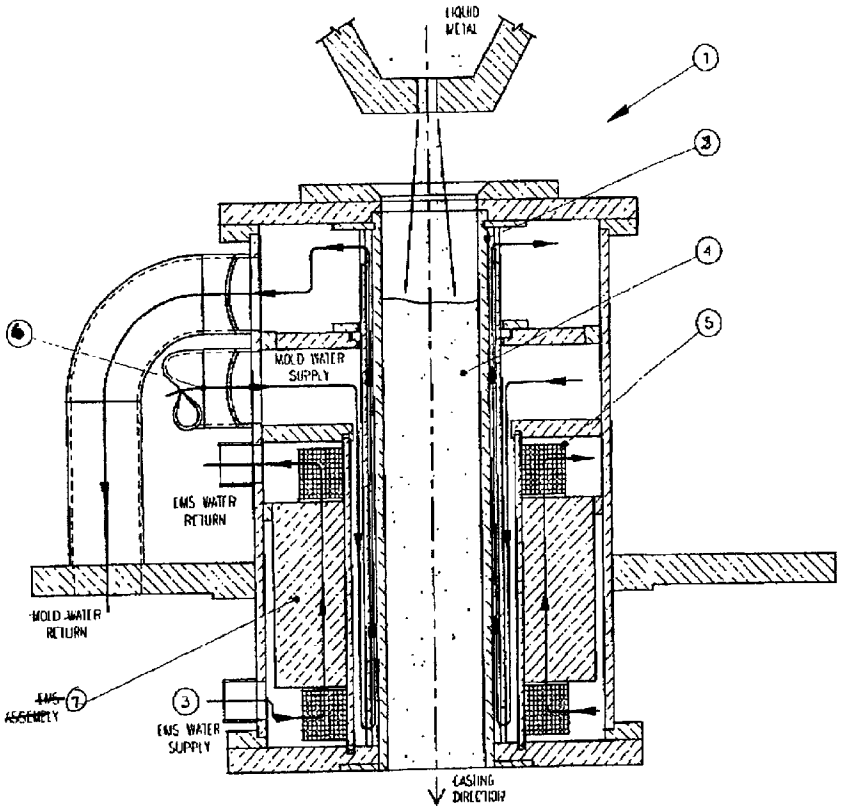
FIG. 1 – SCHEMATIC OF EMS ARRANGEMENT IN THE MOLD HOUSING IN ACCORDANCE WITH ONE METHOD OF COOLING WINDINGS WITH WATER

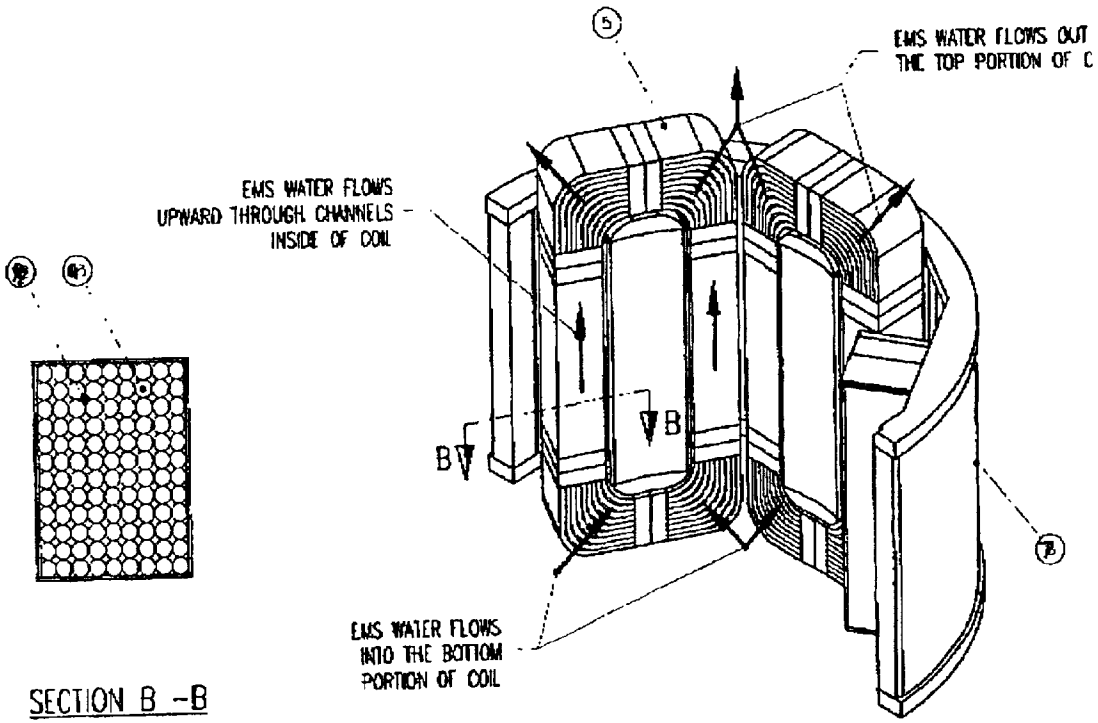
FIG. 2 - SECTIONAL VIEW OF EMS STATOR WITH WATER COOLED WINDINGS

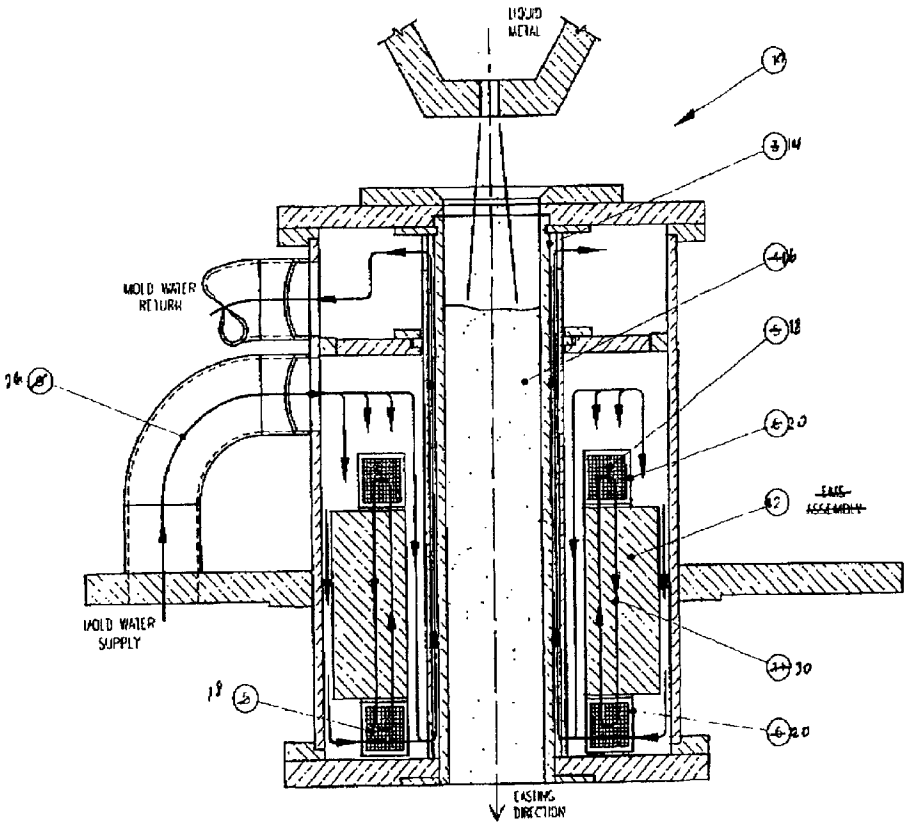
FIG 3 - SCHEMATIC OF EMS ARRANGEMENT IN THE MOLD HOUSING IN ACCORDANCE WITH ONE EMBODIMENT OF COOLING WINDINGS WITH FERROFLUID

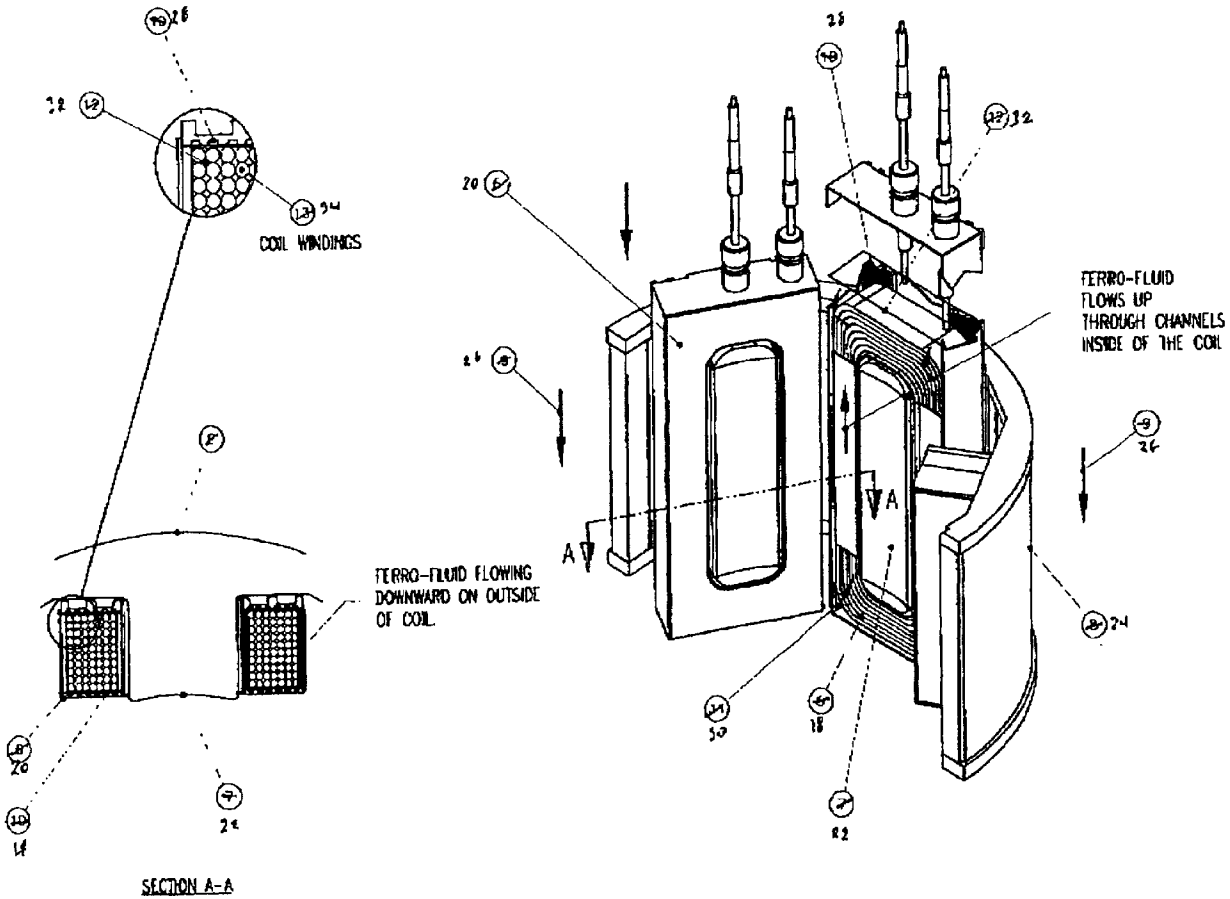
FIG 4 – SECTIONAL VIEW OF THE EMS ASSEMBLY WITH WINDINGS COOLED BY FERROFLUID

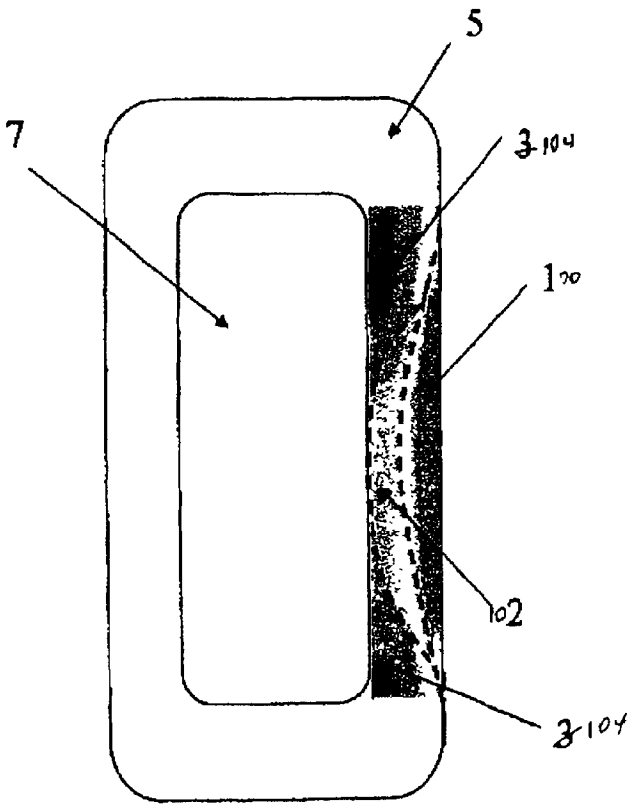
FIG. 5 MAGNETIC FLUX DENSITY DISTRIBUTION IN THE VERTICAL PORTION OF A WINDING

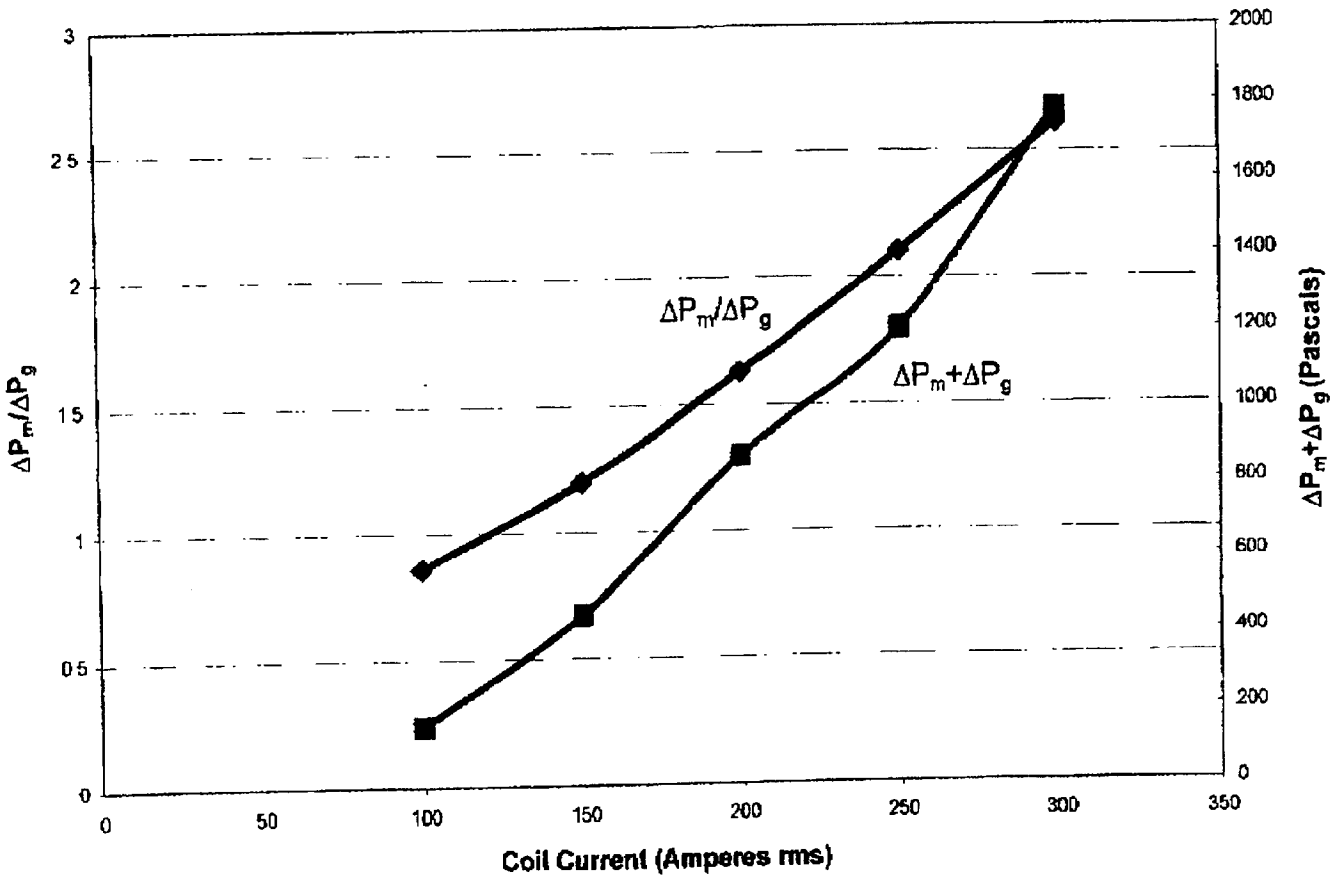
FIG 6 RELATIONSHIP BETWEEN MAGNETIC AND GRAVITATIONAL GRADIENTS OF PRESURE, AND TOTAL PRESURE GRADIENT AT VARYING CURRENT INPUTS

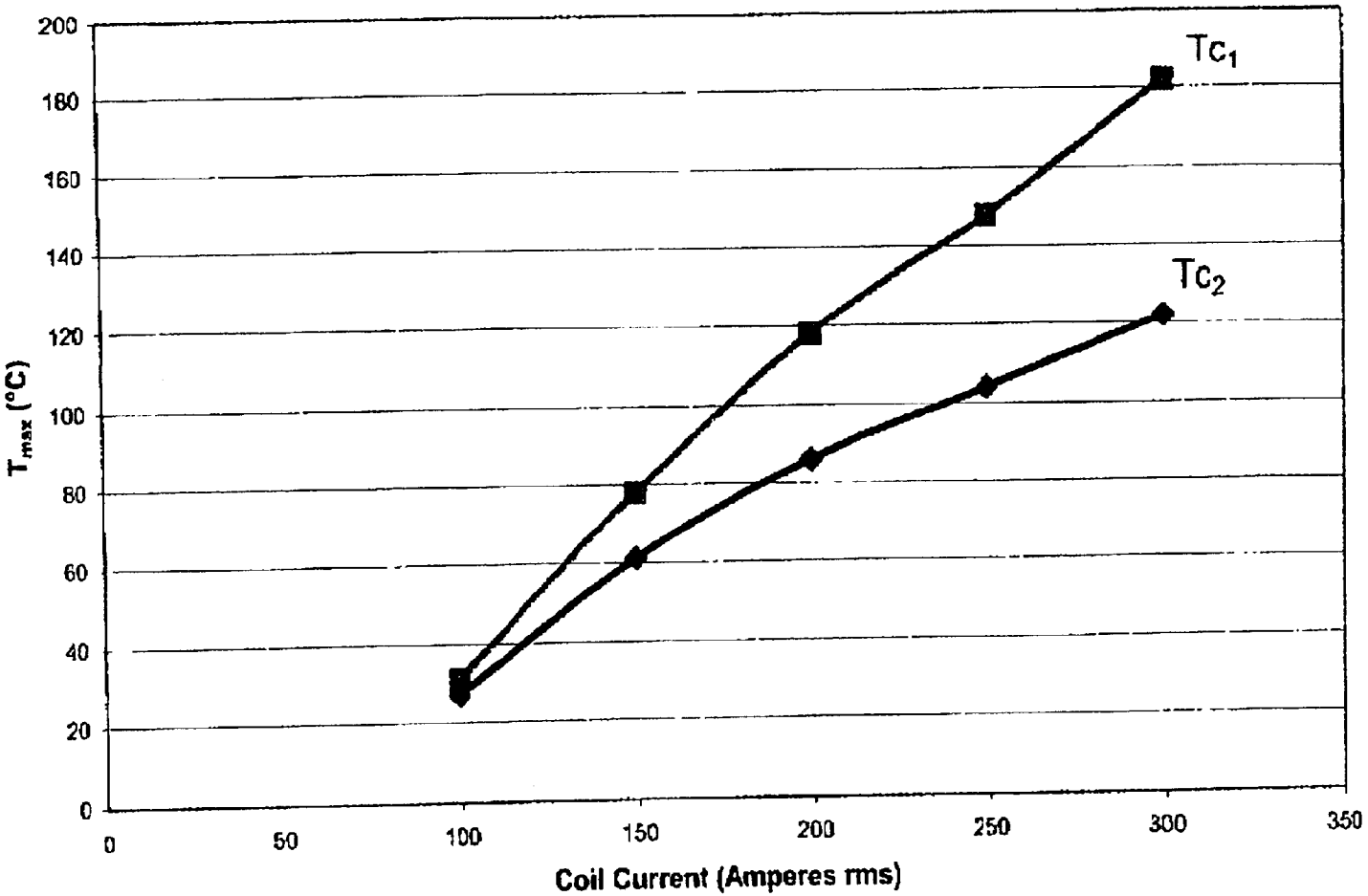
FIG. 7 EFFECT OF FERROFLUID CURIE POINT ON WINDING TEMPERATURE AT VARYING CURRENTS

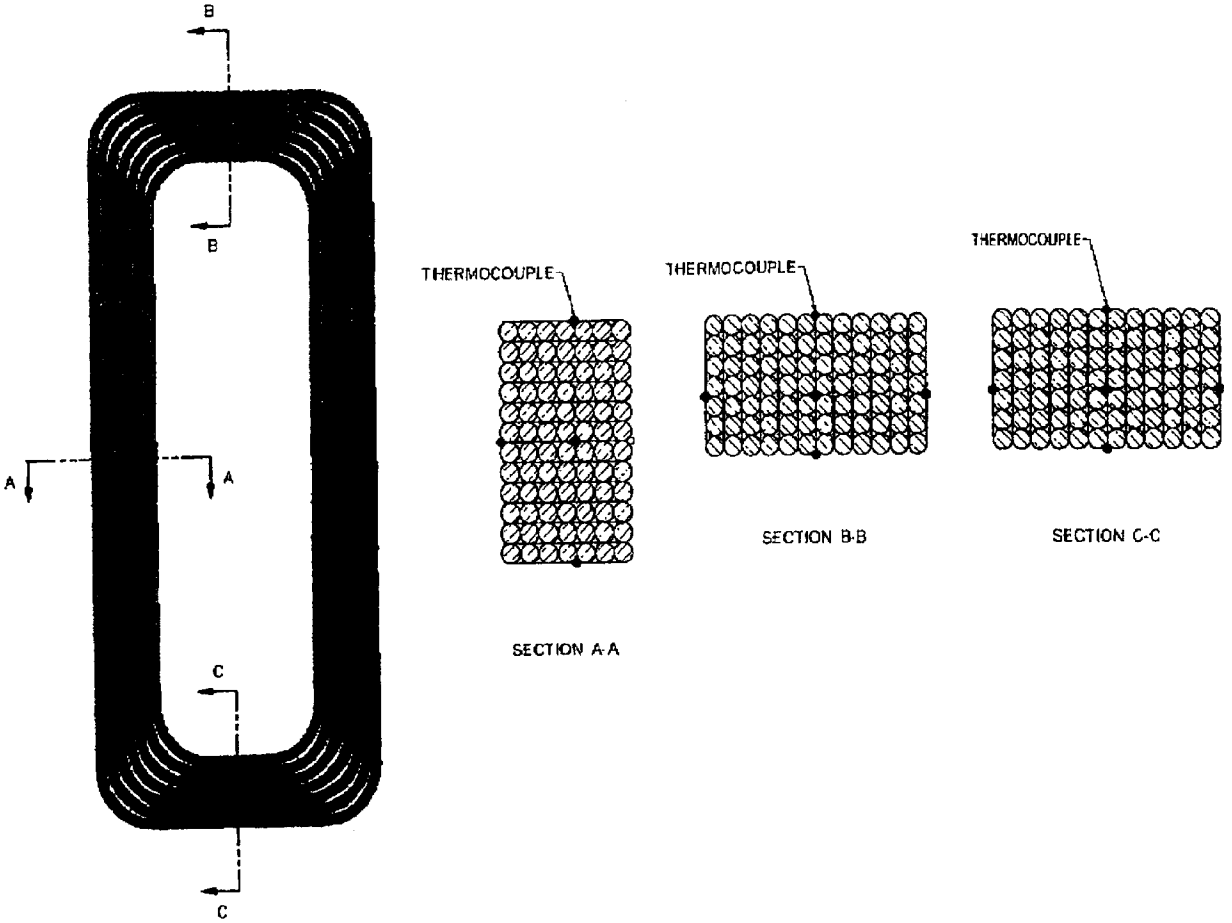
FIG. 8 - SCHEMATIC OF THERMOCOUPLE ARRANGEMENT IN THE WINDING

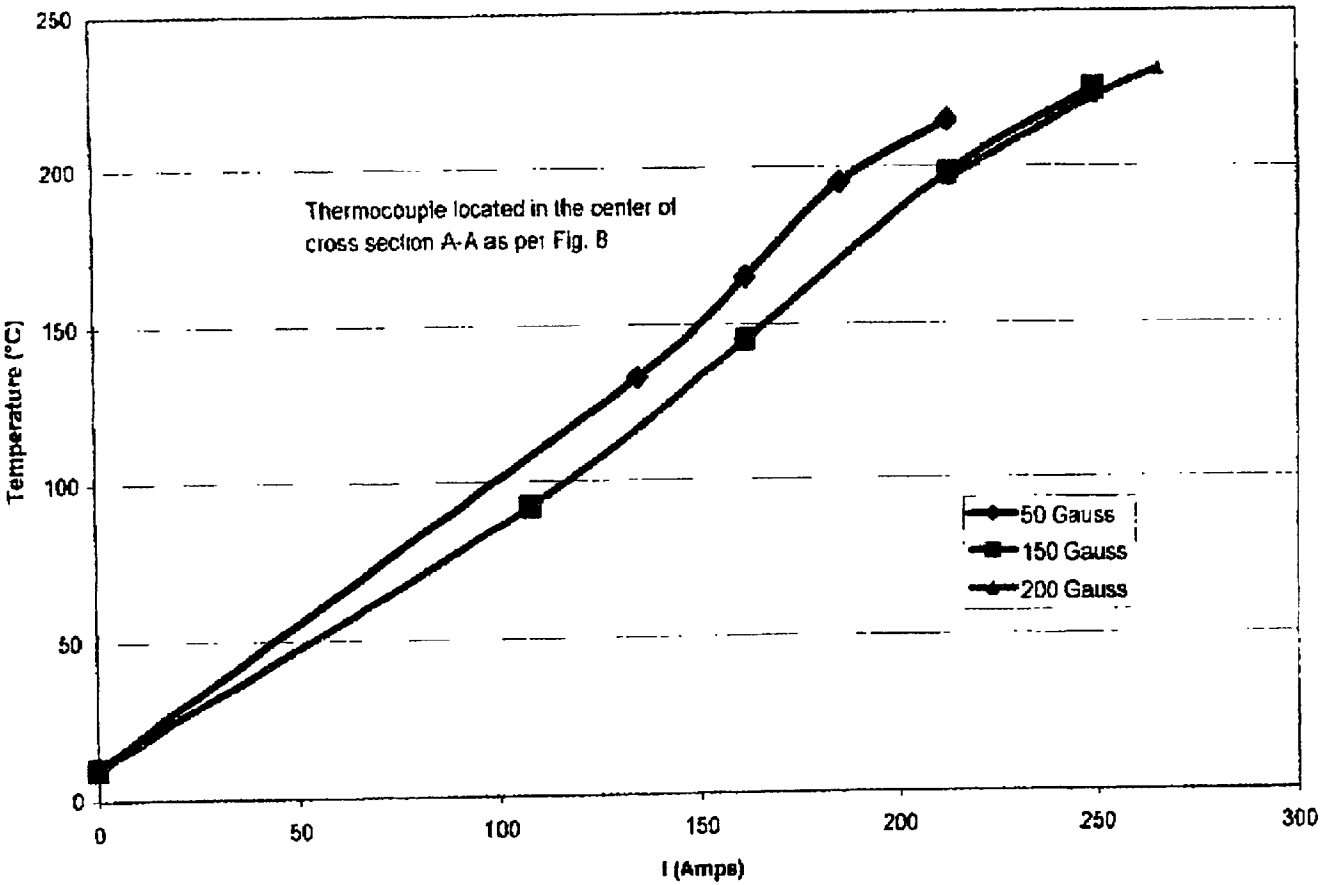
FIG. 9 EFFECT OF FERROFLUID MAGNETIZATION SATURATION ON WINDING TEMPERATURE AS PER EMBODIMENT NO. 1

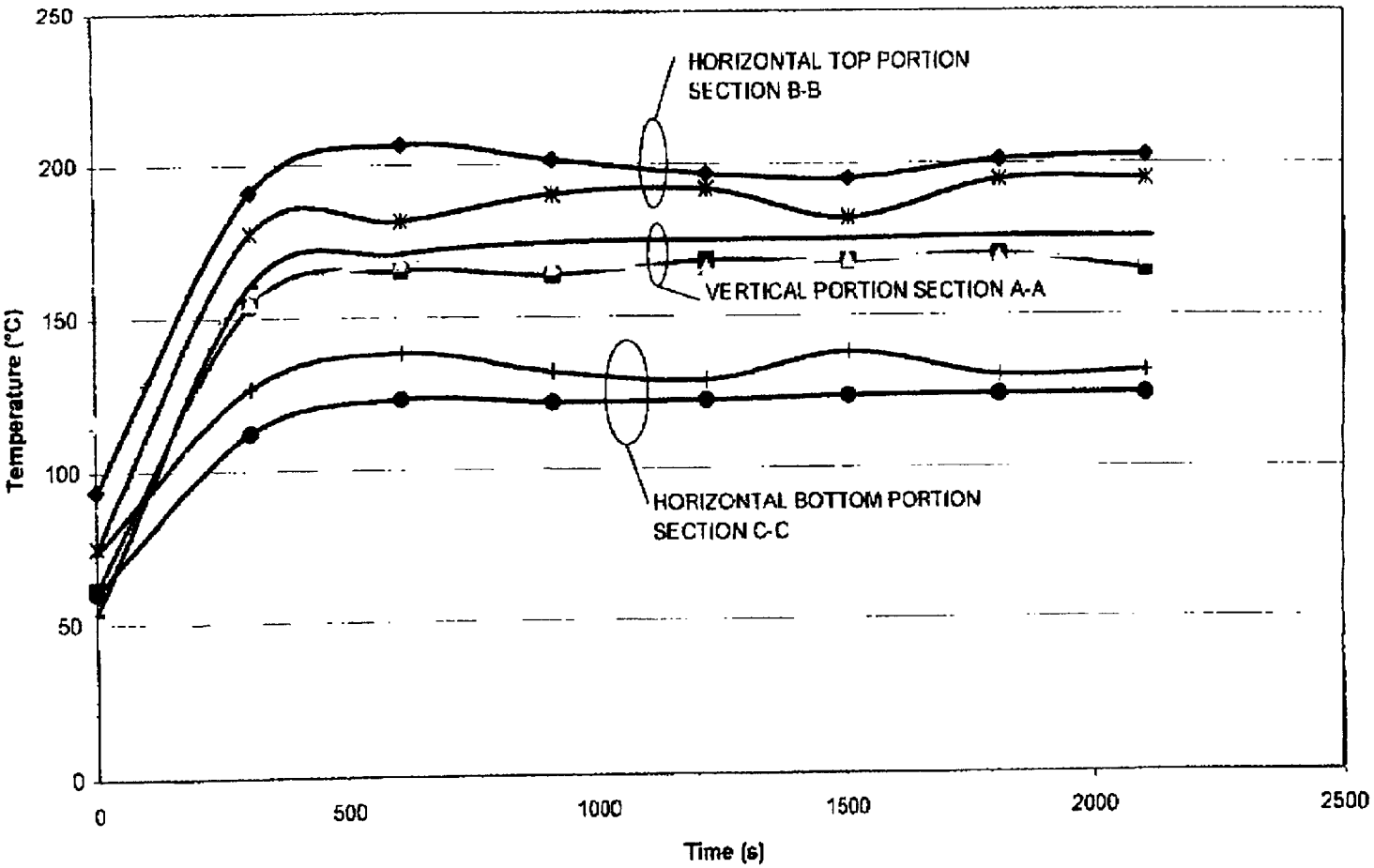
FIG. 10 TEMPERATURE PROFILES IN THE WINDING UNDER CONDITIONS OF EMBODIMENT NO.3

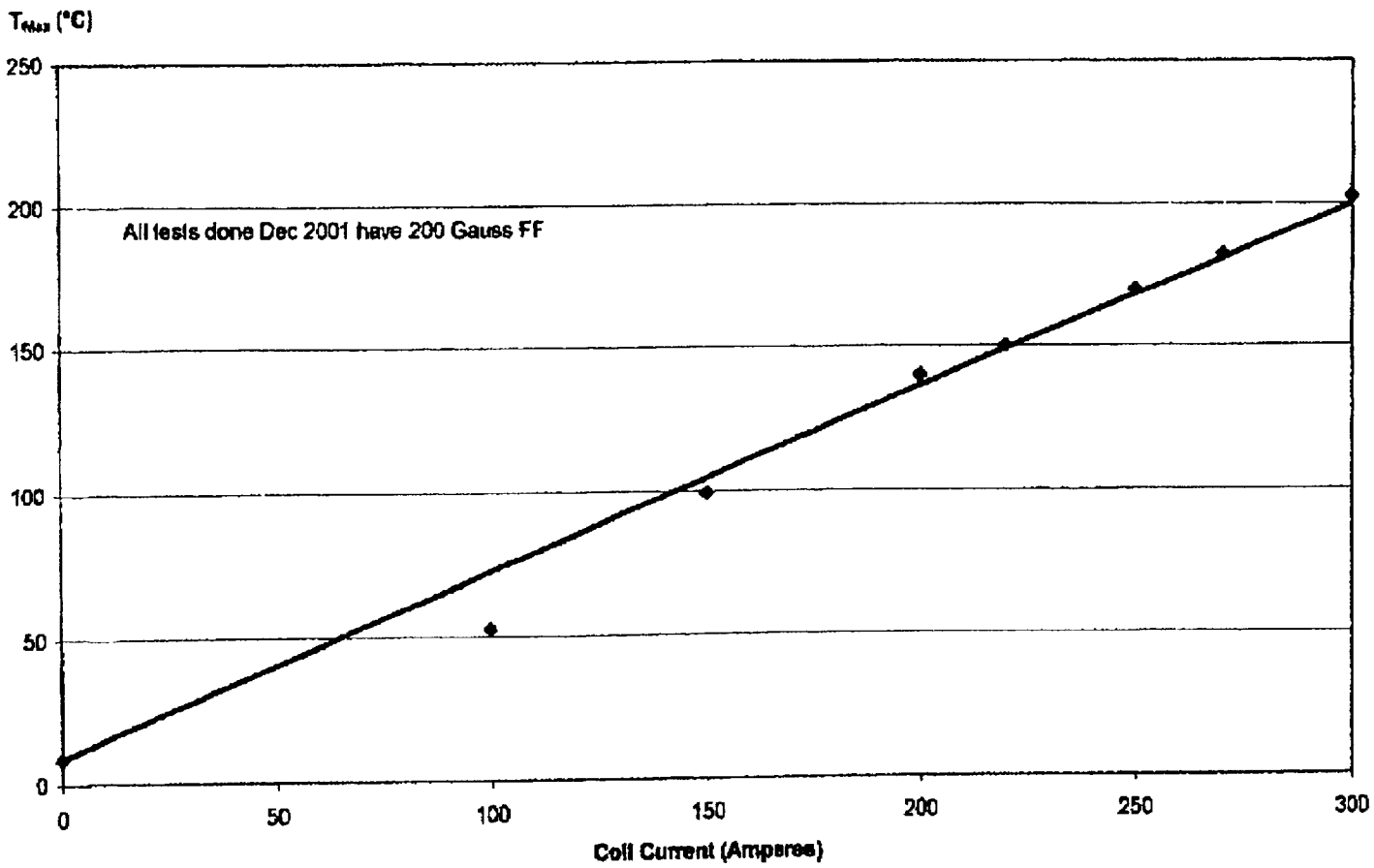
FIG. 11 RELATIONSHIP BETWEEN MAXIMUM TEMPERATURE IN THE WINDING (TOP PORTION SECTION C-C) AND CURRENT UNDER CONDITIONS OF EMBODIMENT NO. 3

COOLING ELECTROMAGNETIC STIRRERS

FIELD OF INVENTION

The present invention relates to generally to electromagnetic devices producing magnetic fields with a significant spatial gradient, and more specifically to cooling systems of electromagnetic stirrers employed for stirring liquid metals.

BACKGROUND TO THE INVENTION

Universally, the windings of electromagnetic devices of comparatively large power input are cooled with fluids, such as oils or water, which remove the heat evolving in the windings due to ohmic losses. The mechanism of heat removal from the windings of such devices is based on either thermal convection or forced fluid flow. The latter approach has been used for cooling of electromagnetic stirrers, (abbreviated herein as EMS), widely used in metals processing industries. These stirrers are cooled by water supplied under pressure either from a dedicated source or for cooling of a casting mold.

In accordance with the most commonly used method, the cooling water flow fills in a space volume accommodating the stirring coils and extracts the heat from the outside of individual wires of the coil windings. FIGS. 1 and 2 show an embodiment of such a cooling system commonly used with an EMS for continuous casting of steel billets and blooms. The EMS 7 is arranged within a continuous casting mold assembly 1 which is comprised of a vertical mold 2 into which is received molten metal 4 which is surrounded by an EMS 7. The water flow 3 enters the windings 5 of the EMS at the bottom portion of the windings and travels upwardly in the space 8 provided between individual wires 9, then, as shown in FIG. 2, the flow 3 exits from the upper portion of the winding. With this cooling arrangement, the winding insulation is in direct contact with water. Because untreated water has rather high electrical conductivity, the water needs to be chemically treated to reduce the electrical conductivity to acceptable levels and/or the wire insulation is reinforced in order to eliminate any microscopic pores in the insulation to avoid a possibility of direct contact between the copper wire and water, which leads to copper erosion and eventual failure of the device. Moreover, both reliable wire insulation and a voltage limitation are required in order to prevent short circuiting between the rather tightly packaged windings, as the cooling water, even with a reduced electrical conductivity, is a poor insulating medium. In industrial practice, neither of the above approaches, i.e. the water electrical conductivity reduction or enhancement of electrical insulation, for example, with a resin, varnish or similar compounds, provides a guaranteed reliability of the stirring coils.

Another approach to cooling windings with water is to use a hollow conductor for winding manufacture. In hollow windings, the cooling water flows inside the conductor while the electrical insulation on the outside remains dry. The cooling water in that instance is also treated in order to avoid an electrolytic reaction causing deposits to be formed on the inside walls of tubular conductors. The above noted water-cooling systems for external or internal cooled windings comprise of a closed circuit water supply equipped with pumps, filters, instrumentation, etc. which adds to capital and operating costs of electromagnetic stirring systems.

A novel concept of cooling electromagnetic devices with fluids which display magnetic behaviour became known in the 1960's (ref. R. E. Rosensweig, *Ferrohydrodynamics*, Cambridge University Press, 1985). An interaction between magnetic fields and magnetic fluids results in a body force which sets the fluid in motion. This property of magnetic response is used in many practical applications, including cooling of electromagnetic devices.

U.S. Pat. No. 5,898,353 describes the use of a magnetic fluid for convective cooling of a distribution transformer. A gradient of magnetic field produced by the transformer produces a circulation pattern in magnetic fluid which cools the transformer windings submerged in the fluid.

U.S. Pat. No. 5,863,455 describes methods of cooling electromagnetic devices, including power transfomers, with magnetic colloidal fluid which has improved insulating and cooling properties. The patent refers to an electromagnetic device comprising means for producing an electromagnetic field, heat, and a stable colloidal insulating fluid which is in contact with the device. The magnetic fluid in the above application has a saturation magnetization of about 1 to 20 Gauss. An electromagnetic device relevant to that patent was a power transformer.

Other prior art includes U.S. Pat. Nos. 4,506,895, 4,992,190 and 5,462,685.

In spite of these prior art disclosures, electromagnetic stirrers employed in the metals processing industries, and continuous casting of steel in particular, remain water-cooled, except for stirrers with a very limited power input which may be air-cooled. The water-cooled systems impose special requirements and equipment for treatment of water, instrumentation for monitoring and maintaining its properties, special demand for electrical insulation integrity, special equipment (e.g. pumps, filters, piping, etc.) which makes reliability and performance of the stirrers dependent on the above parameters and equipment. This dependence can be, and often is compromised by defects in stirrer fabrication, materials used, equipment malfunction or human error.

SUMMARY OF INVENTION

In order to overcome the disadvantages of water-cooling systems used with electromagnetic stirrers, it has been found, in accordance with the present invention, that cooling efficiency and operating performance of electromagnetic stirrers can be improved by the use of magnetic fluid as a cooling and insulating medium.

In accordance with the present invention, an improved method is provided for cooling electromagnetic stirrer windings, in which a colloidal magnetic fluid with insulating properties, which is referred to hereinafter as ferrofluid, is employed as the coolant. The windings of the electromagnetic stirrer are cooled by motion of the ferrofluid which is set in motion by magnetic convection resulting from an electromagnetic field produced by the device. As the electromagnetic device is energized, due to the gradient of magnetic flux density produced by the device, a differential pressure in the ferrofluid arises, resulting in magnetic convection flow of the ferrofluid in a direction of lesser pressure through space formed between a multitude of individual windings. In another aspect of the invention, there is provided an apparatus for carrying out the method.

The flow of ferrofluid dissipates heat evolving within the windings due to ohmic losses and transports the heat to the inner walls of the enclosure. The outer walls are cooled with a water flow.

By eliminating a dedicated source of cooling water supply and equipment associated with it, the stirrer cooling system is simplified, leading to a reduction of capital and operating cost as compared with a water-cooling system.

Any possibility of a contact between current carrying windings and electroconductive cooling medium, i.e. water, is eliminated.

By using a magnetic insulating fluid, heat transfer from the windings to the cooling medium is enhanced, by reducing electrical insulation of the winding. The insulation reduction can be accomplished by reducing the thickness of insulation and/or employing insulating materials with better heat conductivity which is often related to a reduced electrical resistivity.

In addition, there is provided an ability to employ increased current density in the windings, up to about 15 $A/mm^2$ or greater, which becomes possible due to an improved heat removal from the windings and a reduced possibility of the windings short circuiting in a dielectric fluid.

The use of the ferrofluid increases the service life of the electromagnetic device as the intrinsic insulating and magnetic properties of a colloidal ferrofluid remain unchanged for a very extended period of time, including many years. In contrast, a single malfunction of a water-cooling system may result in damage or failure of the electromagnetic device windings.

In the present invention, the windings of an electromagnetic stirrer are arranged within a sealed housing mounted on salient magnetic poles of an iron yoke. The housing is fabricated from non-magnetic stainless steel, or other non-magnetic material with a reasonably good thermoconductivity, and filled with ferrofluid, which also has insulating, i.e. dielectric, properties. The windings are totally submerged in the ferrofluid. The outside of the housing is cooled by water flow used for cooling the casting mold, or it may be supplied from other source.

The ferrofluid is comprised of a carrier fluid with dielectric properties, e.g. synthetic or mineral oils, and nano-sized magnetic particles which are suspended in the fluid. The particles are dispersed within the fluid and form a colloidal suspension. A special coating prevents particles from agglomeration. These types of colloidal magnetic fluids are commonly referred to as "ferrofluids" and their details are described in many publications, e.g. U.S. Pat. Nos. 5,462,685 and 5,863,455.

Magnetic properties of a ferrofluid depend on the concentration of magnetic particles and are quantitatively characterized by saturation magnetization M rate in units of Gauss, which is defined as the maximum attainable magnetic moment per unit volume of fluid. As the magnetic properties of a ferrofluid depend also on the temperature, magnetization saturation of a ferrofluid is decreasing with a temperature rise. Thus, it is beneficial to employ a ferrofluid for cooling of an EMS with a Curie temperature, i.e. the temperature at which magnetic strength approaches zero, rather close to a maximum operating temperature of the particular windings (typically 150° to 250° C.).

A ferrofluid with such characteristics provides the strongest convection, since cooler ferrofluid at the bottom portion of the windings is drawn in due to attraction to the areas adjacent to the magnetic poles which exhibit the strongest magnetic field. As the ferrofluid flow progresses upward through the windings, its temperature rises and magnetic strength diminishes, which facilitates fluid exit from the top portion of the windings. The hot fluid flow exits the top portion of the winding and flows downward between the outer layer of windings and the housing inner walls which are water-cooled from the outside. As a result, cooled ferrofluid flow returns to the bottom portion of the housing, and the cooling cycle repeats.

A thermally induced convection takes place due to a fluid density decrease with temperature rise, i.e. natural convection. However, it plays a relatively minor role in the overall cooling process. Natural convection begins to prevail over the magnetic attraction of the fluid only when the magnetic field is weak, which commonly occurs at a low current supplied to the coils, or the fluid temperature is approaching to the Curie point in the upper portion of the winding before the fluid exits the windings.

The ferrofluid preferably has dielectric properties which correspond to electrical resistivity of at least about $10^9$ ohm·meters. Such electrical resistivity allows a reduction and, in principle, complete removal of wire electrical insulation, which facilitates heat transfer from winding to ferrofluid.

The ferrofluid preferably has a magnetization saturation in the range of about 50 to about 200 Gauss, more preferably towards the upper end of this range. The ferrofluid preferably has a Curie temperature in the range of about 500° to about 300° C., more preferably toward the low end of this range.

In the present invention, there is no direct contact between water and current-carrying windings, eliminating the need to use specially-treated water with a very low electrical conductivity and use heavy-duty electrical insulation for the windings. The ferrofluid is self-propelled to ensure a sufficient rate of heat extraction from the windings and heat transfer through water-cooled stainless steel enclosures.

BRIEF DESCRIPTION OF DRAWINGS

FIG. 1 is a schematic representation of an EMS arrangement in a continuous casting mold assembly unit in accordance with the prior art method of cooling the windings by an externally supplied water flow;

FIG. 2 is a sectional view of an EMS showing a winding assembly on an iron yoke in accordance with the arrangement presented in FIG. 1;

FIG. 3 is a schematic representation of an EMS arrangement in a continuous casting mold assembly in accordance with one embodiment of the present invention;

FIG. 4 is a sectional view of an EMS assembly with windings cooled by ferrofluid as shown in FIG. 3;

FIG. 5 is based on a computer simulation schematic of magnetic flux density distribution in the vertical portion of the windings of the EMS assembly of FIG. 3;

FIG. 6 is a graphical representation of an example of averaged magnetic and gravitational pressures in the ferrofluid at different current inputs;

FIG. 7 is a graphical representation showing the effect of ferrofluid Curie point on winding temperature at varying currents;

FIG. 8 is a schematic view of the thermocouples arrangement in the winding used in experimental trials of the EMS assembly of FIG. 3;

FIG. 9 is a graphical representation showing the experimentally obtained winding temperature under conditions of embodiment of No. 1, as described below;

FIG. 10 is a graphical representation showing temperature profiles in the winding measured under conditions of embodiment No. 3, as described below; and FIG. 11 is a graphical representation showing the relationship between maximum temperature in the winding and the current input under conditions of embodiment No. 3.

DETAILED DESCRIPTION OF PREFERRED EMBODIMENTS

Referring to the drawings, FIGS. 3 and 4 show a schematic depiction of an EMS arrangement within a mold housing assembly 10 installed on a continuous casting machine (not shown here), in accordance with one embodiment of the invention. As seen in FIGS. 3 and 4, an EMS stator 12 is arranged around the casting mold 14, which contains a solidifying melt 16 which is continuously poured into and withdrawn from the mold 14. The windings 18 are enclosed in stainless steel housings 20 which are mounted on salient (protruding) pole pieces 22 shown in FIG. 4. The salient poles 22 are part of the EMS iron yoke 24 and these two components together comprise the EMS stator 12. The casting mold 14 and the stirrer, including the coil stainless steel housings 20 and the EMS stator 12, are cooled by the water flow 26 used for cooling the mold 14.

All the above components, i.e. the iron yoke, windings, salient poles and stainless steel housings, comprise the EMS assembly. The winding housing 20 separates the windings 18 from the mold cooling water 26. As these housings are in the path of both magnetic field produced by the EMS and the heat flow extracted from the windings, they are fabricated from a non-magnetic, heat conducting material with a comparatively high electrical resistivity. Non-magnetic stainless steel is such a material which may be utilized. The winding housings 20 have grooves 28 on the inside of their front and back walls. The grooves 28 facilitate flow of ferrofluid 30 which fills in the housings 20 in such a way as to provide for full submergence of the windings 18.

Ferrofluid 30 is forced to enter a low portion of the windings 18 through specially provided openings (not shown here) under the pressure created by a gradient in the magnetic field strength. Inside the windings 18, ferrofluid 30 travels upward within the channels 32 formed between individual wires 34 of the windings, as shown in the enlargement of Section A—A (FIG. 4). The ferrofluid flow exits the windings 18 through specially provided openings (not shown here) in the upper portion of the windings 18. After exiting the windings, ferrofluid 30 travels downward within the grooves 28. Within the windings 18, ferrofluid 30 absorbs the heat evolving from the winding due to ohmic losses. The heat is removed from descending ferrofluid flow through the walls of the housing 20 which is cooled from the outside by the water flow 26.

In accordance with the present invention, the method of cooling EMS windings by ferrofluid is especially useful for high power devices, as a substantial portion of the power input creates heat due to the winding electrical resistance. Removal of the resistive heat from the coil windings is a major precondition for sustained operation of any electrical device, including EMS. The most important feature of this invention is the fact that heat transfer is accomplished without any direct contact between electrically charged windings and water.

Ferrofluid essentially becomes a liquid magnet when the ultra microscopic magnetic particles suspended in it become magnetized by a magnetic field, while the dielectric matrix of ferrofluid provides strong insulating properties. Magnetization of a given ferrofluid depends on concentration, size of the magnetic particles, and magnetic field strength. Magnetization reaches saturation at a certain level of that magnetic field intensity.

At the same time, ferrofluid magnetization also depends on temperature. With fluid temperature rise, magnetization decreases and becomes zero at the Curie temperature. This dual dependency of magentization on magnetic field strength and temperature is the fundamental reason for the ability of ferrofluid to facilitate convective heat transfer from the EMS windings. A cold ferrofluid is attracted into the interior of the windings due to a pressure gradient produced by the gradient of magnetic flux density outside and within different locations of the windings. The magnetic pressure gradient is represented by the expression:

$$\Delta P_M = \Delta B \cdot \bar{M}$$

Where $\Delta P_M$ is the magnetic pressure gradient $\Delta B$ is the magnetic flux density gradient $\bar{M}$ is the field-averaged magnetization of the ferrofluid Ferrofluid travels inside the channels formed between the winding wires from the region of a lower magnetic pressure to regions of a higher magnetic pressure which acts as an attraction force.

FIG. 5 represents an example of magnetic flux density distribution in the vertical cross-section of the windings adjacent to the magnetic pole (only a half of the cross-section is shown). As seen, magnetic flux density increases in regions 100 to 102 toward the mid-plane of the vertical portion of the winding. At the same time, flux density is comparatively low in area 104 at the bottom and top of the vertical portion which facilitates magnetic pressure gradient, and consequently ferrofluid flow in the winding. As ferrofluid temperature increases with time of travelling toward the winding top end, the magnetization diminishes and the fluid is no longer so strongly attracted to the windings, which facilitates fluid flow exit. The change in the ferrofluid gravitational density with a temperature increase results in natural convection which is in the same direction as the magnetically induced convection. These two pressure gradients facilitate fluid flow through the windings and the proportion of each is shown in FIG. 6. As seen in FIG. 6, with a current increase, both magnetic and gravitational components of the pressure gradient increase, but the magnetic pressure increases at a much greater rate and becomes the prime force in ferrofluid motion even at a relatively low level of the current. The combined effect of both magnetic and natural convections on total pressure gradient in the fluid is also shown in FIG. 6.

As fluid pressure in the winding channels depends on the magnetic interaction between the ferrofluid and the magnetic field, reduction of ferrofluid magnetization with temperature plays a key role in providing conditions beneficial for fluid motion and overall efficiency in the winding cooling.

Therefore, it is beneficial to have a ferrofluid with a Curie temperature close to the maximum operating temperature of the windings. Magnetic properties of ferrofluid in that case are greatly reduced with temperature rise which facilitates the flow exit. Such a ferrofluid results in increased flow through the winding, heat removal, and consequently, a reduction in the winding temperature, as exemplified in FIG. 7.

As seen from FIG. 7, a ferrofluid with a Curie temperature of 327° C. (marked as $T_{C2}$) can maintain a winding temperature of approximately 125° C. with a current input of 300 Amperes, which is 60° C. lower than that which can be obtained with a ferrofluid having the Curie temperature of 590° C. (marked as $T_{C1}$). The above fundamental considerations have been verified by the experiments carried out with the following embodiments of this invention.

Embodiment No. 1

In order to determine temperature within the windings at different current inputs and ferrofluid magnetizations, fifteen thermocouples were embedded into one winding as shown in FIG. 8. There were three sets of five thermocouples, each set having one thermocouple in the center of a cross-section and four in the middle of its sides. The winding crosssections were selected as follows: one in the mid-height of the vertical portion, i.e. section A—A, and one each in the bottom and the top horizontal portions of the windings, as indicated respectively by sections C—C and B—B in FIG. 8.

FIG. 9 shows the temperatures obtained in the vertical portion of the winding, i.e. section A—A, at different current inputs and magnetizations of ferrofluid. As seen from FIG. 9, with a magnetization of 150 and 200 Gauss, the winding temperature reached 200° C. at 200 Amperes. In this embodiment, similar to the practice of cooling windings with water, the wire has a multi-layer insulation. The grooves 28 as shown in FIG. 4, were rather small in that trial. This embodiment shows that a further increase in ferrofluid saturation magnetization M above 150 Gauss has no practical effect on winding cooling.

Embodiment No. 2

By comparing results of the trials in accordance with embodiment No. 1 with the analytical estimates of the magnetic pressure drop, it was concluded that the full effect of magnetic convection was not utilized.

Embodiment No. 1 was modified by increasing cross-section of the grooves 28 in order to increase ferrofluid flow. As a result of this improvement, a significant decrease in maximum temperatures was achieved, which allowed a current increase up to 250 Amperes. In order to further improve the winding cooling, the wire insulation thickness was reduced.

Embodiment No. 3

This embodiment includes the enlarged grooves 28 of Embodiment No. 1 and wire insulation with reduced thickness. The experimental results of winding temperatures under the conditions of this embodiment are shown in FIGS. 10 and 11. FIG. 10 shows temperatures measured in different sections of the winding at the current input of 300 Amperes and ferrofluid saturation magnetization M=200 Gauss.

FIG. 11 shows the relationship between maximum registered temperature in the winding (the section B—B) and the current input. As seen from FIGS. 10 and 11 at 300 Amperes, the maximum temperature reached approximately 200° C. This is a marked improvement over the results obtained with the embodiments Nos 1 and 2, and as well over the operating practice with cooling winding by the water. In the latter instance, the current is limited to 200 Amperes. Further improvements in winding cooling with ferrofluid can be obtained by optimizing the Curie temperature in relation to the maximum operating temperature, as shown in FIG. 7. Therefore, the experimental data obtained from Embodiment No. 3 clearly supports the main premise of this invention, i.e. magnetically forced convection of a ferrofluid provides efficient cooling of electromagnetic coils in commercial electromagnetic stirrers while avoiding direct contact between the coil windings and the cooling water. The EMS winding cooling by ferrofluid simplifies the cooling system, reduces its capital and operating costs and increases the system reliability.

SUMMARY OF DISCLOSURE

In summary of this disclosure, the present invention provides an improved method for cooling electromagnetic coils by eliminating any direct interaction between current-carrying windings and cooling water. By substituting water with a dielectric, magneto-active colloidal fluid, i.e. ferrofluid, a strong magneto-convective flow is created within the windings due to an interaction with a magnetic field produced by the electromagnetic stirrer. Modifications are possible within the scope of the invention.

What is claimed is:

1. A method of cooling an electromagnetic stirrer used for stirring liquid metals, which comprises:

providing an assembly having an iron yoke with salient magnetic poles and electrical windings mounted on the magnetic poles and arranged in non-magnetic conductive housings filled with a dielectric ferrofluid, operating the electromagnetic stirrer to produce a magnetic field with substantial magnetic flux density gradients in the windings which produce a magnetic pressure in the ferrofluid which is at least sufficient to create a flow directed from the periphery to the inside of the winding.

2. The method of claim 1 wherein the ferrofluid has dielectric properties which correspond to an electrical resistivity of at least about $10^9$ ohm·meters.

3. The method of claim 1 wherein the ferrofluid has magnetization saturation in the range of about 50 to about 200 Gauss and a Curie temperature of about 500° to about 300° C.

4. The method of claim 1 wherein the housings are constructed of non-magnetic stainless steel.

5. The method of claim 1 wherein grooves are provided on both the internal and external walls of the winding enclosure to facilitate ferrofluid flow from the inside and cooling water from the outside of the enclosure.

6. The method of claim 1 wherein the liquid metal is steel.

* * * * *